United States Patent [19]

Ohta et al.

[11] 4,287,278

[45] Sep. 1, 1981

[54] TWO SUPERIMPOSED ION CURRENT FORMED IMAGES USING PHOTOCONDUCTIVE SCREEN GIVES WIDER POTENTIAL RANGE FOR GRADATION CONTROL IN ELECTROPHOTOGRAPHY

[75] Inventors: Tatsuo Ohta; Sohji Shinozaki; Syusaku Yoshida; Hideo Ohba, all of Hino, Japan

[73] Assignee: Konishiroku Photo Industry Co., Ltd., Tokyo, Japan

[21] Appl. No.: 132,521

[22] Filed: Mar. 21, 1980

[30] Foreign Application Priority Data

Mar. 27, 1979 [JP] Japan ..... 54-35039

[51] Int. Cl.[3] ..... G03G 13/052

[52] U.S. Cl. ..... 430/53; 430/54; 355/3 SC; 118/650

[58] Field of Search ..... 430/53, 54; 118/650; 355/3 SC

[56] References Cited

U.S. PATENT DOCUMENTS 4,090,876 5/1978 Furuya et al. ..... 430/53

*Primary Examiner*—John D. Welsh

*Attorney, Agent, or Firm*—Bierman & Bierman

[57] ABSTRACT

A method for forming an electrostatic latent image on an image recording medium includes forming a primary electrostatic latent image on a screen-type photosensitive plate, forming a secondary electrostatic latent image on the image recording material by irradiating the same with a charged particle current passed through the screen-type plate carrying the primary latent image, and correcting the secondary latent image on the recording material by irradiating the same with a charged particle current passed through the screen-type plate carrying the primary latent image.

6 Claims, 4 Drawing Figures

TWO SUPERIMPOSED ION CURRENT FORMED IMAGES USING PHOTOCONDUCTIVE SCREEN GIVES WIDER POTENTIAL RANGE FOR GRADATION CONTROL IN ELECTROPHOTOGRAPHY

The present invention relates to a method of forming an electrostatic image, and more particularly to a method of forming an electrostatic image by the use of a screen type photosensitive plate.

In electrophotography, a visible image is generally formed by the use of a photosensitive plate having a photoconductive layer on an electroconductive support and a process which comprises uniformly charging said photosensitive plate, exposing imagewise said photoconductive layer to light, and then developing the thus formed electrostatic latent image with toner. However, one of the difficulties accompanying electrophotography of this method is in reproducing an original image having wide density gradation.

For sufficient reproduction of the gradation, it is first necessary to form an electrostatic latent image having such a potential gradation that changes proportionally corresponding to a density change in the image pattern of an original, and to develop such electrostatic latent image so that a density change corresponding proportionally to the potential change can be produced. However, to form such an electrostatic latent image having wide potential gradation is almost impossible by the use of existing electrophotographic techniques since in reality the reproducable potential gradation range is narrower than the density gradation of an original image and formation of the toner image by development is therefore usually difficult.

In heretofore known methods for reproducing such density gradation, the electric potential or density thereof on the surface of a photosensitive plate is controlled by means of adjusting the mobility and potential distribution of electric charge in an electrostatic latent image forming process, which may be attained by appropriately choosing the characteristics of the photosensitive plate as for example by means of sensitization and amount of exposure. However, these known methods are still far from fundamentally solving the problems described above. One of the other approaches to improving the reproductivity of gradation is by controlling properties of the toner, i.e. by adjusting particle diameter, tone and electric capacity thereof and then by developing the electrostatic latent image with the toner thus prepared. However, the improvements attained by this technique are still limited within the potential range of the static image.

In the light of the state of art as mentioned, it is an object of the invention to provide a method of forming an electrostatic latent image having a wider range of potential gradation and being capable of producing an original of which the density range is broad.

Figure 1:
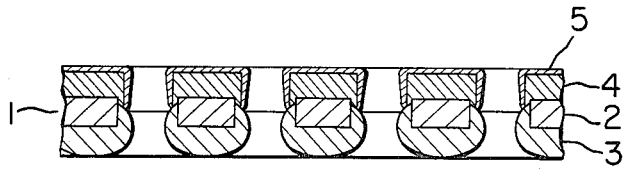

The present invention is described more in detail with reference to one of the preferred embodiments of the invention as seen in the attached drawings, where:

FIG. 1 is a cross-sectional view of a screen type photosensitive plate (hereinafter referred to as the "screen") that is used in the method of the present invention.

Figure 2:
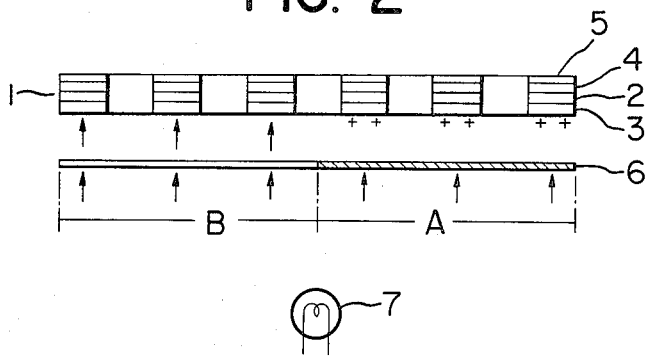
Figure 3:
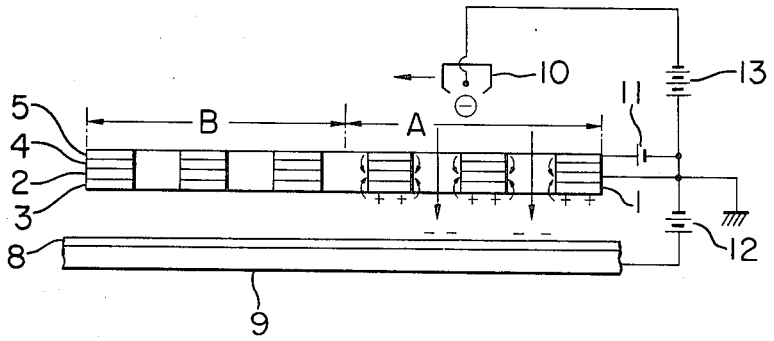
Figure 4:
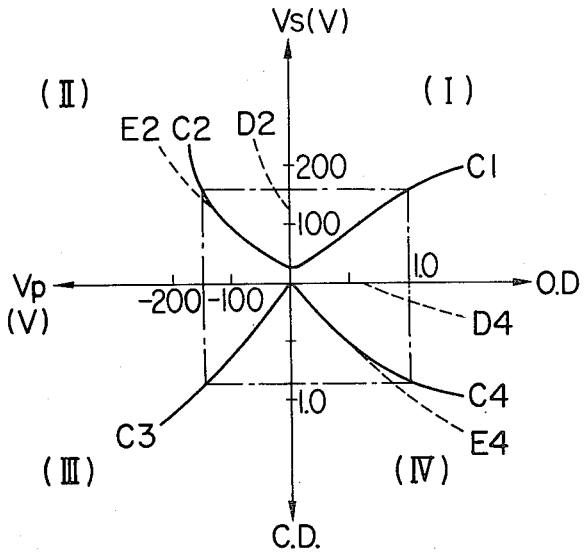

FIG. 2 and FIG. 3 respectively illustrate typical diagrams of the present invention and FIG. 4 illustrates the curves which explain the principle and affect of the present invention, wherein 1 is a screen type photosensitive plate, 2 is a conductive support, 3 is a photoconductive layer, 4 is an insulating layer, 5 is a conductive layer for supplying bias potential, 6 is an original image to be reproduced, 7 is a light source, 8 is an image recording material, 9 is a metallic plate electrode, 10 is an electric discharger and 11, 12 and 13 respectively show power sources.

In FIG. 1, screen 1 consists of a photoconductive layer 3 formed on one surface of a conductive screen base 2 having many fine penetrated openings such as metallic meshes, an insulating layer 4 formed on the other surface of said screen base and another conductive layer 5 for supplying bias potential and which is laminated on said insulating layer 4. By way of example, the conductive screen base 2 may be formed of a stainless steel plate of 20–100 microns thickness having fine openings of 250 meshes with an opening ratio of 50% by way of photo-etching. Photoconductive layer 3 may suitably be formed by means of vacuum evaporating a photoconductive material, such as metallic selenium, selenium-tellurium alloy or selenium-arsenic alloy, etc., on one surface of said base 2, so that the thickness thereof may be approximately 5–60 microns. Insulating layer 4 can be formed by spraying the other surface of said base 2 with a solution in which an electrically insulative synthetic resin such as silicon resin, alkyd resin or vinyl resin, etc, is dissolved, so that the thickness after drying the solution may be approximately 5–50 microns. Layer 4 can alternatively be formed by means of vacuum evaporation of an insulative substance such as paraxylene, etc. The conductive layer for supplying bias potential 5 can be formed by vacuum evaporation of a metal such as gold, platinum, aluminum or copper, etc., on said insulating layer 4.

In the present invention, making use of the screen 1 as described above, an electrostatic latent image is formed as follows.

Firstly, the photoconductive layer 3 of the screen 1 is charged. The polarity of the charge is selected depending on the material of the photoconductive material which is to compose the photoconductive layer 3. For example, it will be positively charged, as in the instant example, when said photoconductive material consists of selenium or its alloy in which positive holes serve as the main carrier. Such charging process can be performed by way of corona discharge from, for example, a tungsten wire of 80 microns diameter disposed against the photoconductive layer 3 and applied with +8 KV while supplying the conductive layer 5 with a bias potential of +200 V. In this instance, the base 1 is kept at zero potential. The primary electrostatic latent image corresponding to an original 6 is formed by imagewise light exposing the thus charged photoconductive layer 3 through the original 6.

In the next step, as shown in FIG. 3, a secondary dotted latent image corresponding to the latent image formed on the screen 1 is formed on the recording material 8, which may be either an electrostatic recording sheet or an insulative resin sheet placed on the metal plate electrode 9. The recording material 8 is placed against the photoconductive layer 3 of the screen 1 at intervals of 4–5 mm, and a scanning electric charger 10 is movably placed against the conductive layer 5 of said screen 1, so as to effect ionic current irradiation on said recording sheet 8 through the screen 1. During this procedure, the potential of said screen 1 is held at zero and +30 V of primary bias potential is applied to the conductive layer 5 by a power source 11; in addition, and at the same time −2 KV is applied to the metal plate electrode 9 by a power source 12 and −8 KV is applied to a 50 micron diameter tungsten wire electrode of the electric charger 10. Thus, with respect to the screen 1, an electric field making possible or further accelerating the passage of the negative ionic current through the openings of the screen is formed in the area A wherein the positive charge on the photoconductive layer 3 exists, whereas within the area B wherein no positive charge on the photoconductive layer 3 exists no such electric field is formed. Consequently, the ionic current can pass through the area A and reach to charge the recording material 8, but it is impeded and cannot pass through the area B, and thus a secondary electrostatic latent image of negative charge is formed on said recording material 8 in positive-to-positive relation with respect to the primary electrostatic latent image on said screen 1.

Moreover, following the same procedures as described above except that a secondary bias potential of +150 V is applied to the conductive layer 5 by the power source 11, the ionic current is irradiated on the recording material 8—on which said secondary electrostatic latent image has been formed—through the primary electrostatic image carrying screen to form a corrected secondary electrostatic latent image.

In the present invention, where said secondary electrostatic image has not already been formed on the recording material 8 by irradiation of the second ionic current, the second secondary image will be formed by this irradiation; but where the secondary electrostatic latent image has already been formed by the first irradiation of ionic current, said secondary electrostatic latent image becomes superimposed by another irradiation of ionic current.

This corrected secondary electrostatic latent image has a wider potential range because of the fact that the two kinds of secondary static charged images are superimposed. Therefore, a visible image having wider density change can be obtained by developing this corrected secondary electrostatic latent image, and consequently the gradation of image density of the original 6 can sufficiently be reproduced.

This image formation process of the present invention can be explained in further detail by reference to FIG. 4.

The right of the axis of abscissas in the FIG. 4 represents O.D., the image density of the original, while the left thereof represents Vp, the potential of the static charged image on the image recording material 8; the upper part of the axis of ordinates represents Vs, the potential of the primary static charged image on the screen 1, and the lower part thereof represents C.D., the density of the visible image obtained after developing. The potential Vs of the primary electrostatic latent image formed on the photoconductive layer 3 of the screen 1 increases with the increase of original image density O.D. as is shown by the curve C1 in the first quadrant, but its increasing rate decreases remarkably as the potential Vs approaches +200 V. Furthermore, the potential Vp of the secondary electrostatic latent image formed in accordance with the primary latent image by the first irradiation of ion current increases with the increase of the potential Vs of the primary electrostatic image, as is shown by the curve C2 in the second quadrant, but its rate of increase decreases remarkably when the potential Vp exceeds −150 V. For this reason, although development is obtainable with a density that is nearly in proportion to the potential Vp of the electrostatic image, as shown by the curve C3 in the third quandrant, when the secondary electrostatic latent image represented by the aforesaid curve C2 is developed without correction, the rate of increase of the density C.D. of the visible image obtained corresponding to the increase of the original image density O.D. decreases remarkably for a density of 0.8 or more as is shown by the curve C4 in the fourth quandrant; accordingly, the so-calleddynamic range in the curve C4 in which the density C.D. increases in proportion to the increase of the original image density and where gradation is accurately reproduced becomes extremely narrow. Thus, when the original image has a wide density range, the density zone above a certain value can be reproduced but in almost the same or nondifferentiable density of the developed visible image as the reproduced density of said certain value.

According to the present invention, on the other hand, irradiation by a second ion current is effected as in the aforesaid example, the second irradiation of ion current being carried out while supplying a higher positive bias potential than the potential supplied to the conductive layer 5 for the first irradiation. Where the aforesaid secondary electrostatic image has not been formed on the image recording material 8, the relationship between the potential Vp of the second secondary electrostatic latent image formed on the image recording material 8 by this second irradiation of ion current and the potential Vs of the first or primary electrostatic image will be, as is shown by the curve D2, that obtained by moving the aforesaid curve C2 upward this being the case because the electric field that inhibits the passage of negative ion current at the opening of the screen 1 increases due to the boosted positive potential applied to the conductive layer 5. And when this second secondary electrostatic latent image is developed, the resulting visible image will have the density range shown by the curve D4, corresponding to the curve C4 being moved to the right.

According to the present invention, however, the aforesaid second secondary electrostatic latent image is superimposed and synthesized over the secondary electrostatic image formed by the first irradiation of ion current. The corrected secondary electrostatic latent image obtained thereby on the image recording material 8 will have potential characteristics corresponding to the curve C2 and the curve D2 being added—as is shown by the curve E2 in the second quandrant—and when this latent image is developed, the visible image obtained will have a density curve corresponding to the curve C4 and the curve D4 being added, as shown by the curve E4. Thus, in this example, the upper density limit, which enables reproduction of the gradation, is extended by the second irradiation of ion current and thereby a gradation of to more than 1.3 of the density C.D. of the visible image developed can be reproduced.

With the present invention, as stated above, an electrostatic latent image with wider potential range can be formed on the image recording material 8 and favorable reproduction of gradiation of the original image can accordingly be attained.

Moreover, although it is necessary in the present invention to repeat the irradiation of ion current, since the screen 1 on which the primary electrostatic latent image is formed can be used for each secondary irradiation of ion current on the image recording material 8, the positional relation between the screen and the image recording material can remain fixed. As a result, there is no positional sheer of the dots to be formed by each irradiation of ion current and an advantage can be attained in that the occurrence of a moiré pattern can thoroughly be eliminated by the present invention.

Furthermore, in the present invention, the operation of forming a secondary electrostatic latent image by the irradiation of ion current can be repeated more than twice and it is also possible to form an electrostatic latent image having an extremely wide potential range by properly setting the voltage applied to the conductive layer 5 in the screen 1. But it is not always necessary to change the bias potential in each of the forming operations of the secondary electrostatic image. In the aforesaid example, for instance, if the second irradiation of ion current is effected with the bias potential kept at +30 V (the same as the potential for the first irradiation), an electrostatic latent image that is equivalent to two times of the curve C2 is formed on the image recording material and no unfavorable gap may occur in the density variation of the visible image developed because, an entirely smooth curve is obtained in this case. The aforesaid bias potential can also be zero potential and, especially when all of the secondary electrostatic latent image forming operations are carried out while maintaining the bias potential at zero potential, it is also possible to use a screen that has no conductive layer for supplying bias potential.

Furthermore, when the electrostatic latent image forming operations are carried out with varied bias potentials, the order thereof is completely optional; for example, even where the first irradiation of ion current is effected with a bias potential of +150 V and the second irradiation of such current is effected with a bias potential of +30 V (the opposite of the aforesaid example), the results obtained therefrom will be quite the same.

It is also possible in the present invention to carry out the formation of the secondary electrostatic latent image with a charge of opposite polarity which has a positive-negative relation with respect to the primary electrostatic image by conducting a part of the plural irradiations of ion current in the present invention with an ion current and potential applied to a metallic electrode plate 9 with polarities opposite those of the other above-described cases. It is also possible to partially reduce the range of potential variation by properly controlling ion current irridiation, adjusting the polarity and/or voltage of bias potential in the secondary electrostatic image-forming process.

With the present invention, as stated above, it is possible to easily form an electrostatic image with the desired range of potential variation for the range of density variation of the original image by using an extremely simple method.

We claim:

1. A method for forming an electrostatic latent image of an original on an image recording material comprising the steps of:

forming a primary electrostatic latent image on a photoconductive layer of a screen-type photosensitive plate;

forming a secondary electrostatic latent image on the image recording material by irradiating the recording material with a charged particle current passed through the screen-type photosensitive plate carrying the primary latent image; and correcting the secondary electrostatic latent image on the recording material by irradiating the recording material bearing the secondary latent image with a charged particle current passed through the screen-type photosensitive plate carrying the primary latent image.

2. A method for forming an electrostatic latent image according to claim 1;

said step of forming a primary electrostatic latent image comprising imparting a substantially uniform electric charge to the photosensitive layer of the screen-type plate, and thereafter exposing the photosensitive layer to an optical image of the original.

3. A method for forming an electrostatic latent image on an image recording material comprising the steps of;

forming a primary electrostatic latent image on a photoconductive layer of a screen-type photosensitive plate;

forming a secondary electrostatic latent image on the image recording material by irradiating the recording material with a charged particle current passed through the screen-type photosensitive plate carrying the primary latent image while applying a primary bias potential to a conductive layer of the screen-type photosensitive plate; and correcting the secondary electrostatic latent image on the image recording material by irradiating the recording material bearing the secondary latent image with a charged particle current passed through the screen-type photosensitive plate carrying the primary latent image while applying a secondary bias potential to the conductive layer of the screen-type plate.

4. A method for forming an electrostatic latent image according to claim 3, wherein the primary bias potential applied to the conductive layer of the screen-type plate is the same as the secondary bias potential applied thereto.

5. A method for forming an electrostatic latent image according to claim 3, wherein the primary bias potential applied to the conductive layer of the screen-type plate is different from the secondary bias potential applied thereto.

6. AA method for forming an electrostatic latent image according to claim 3, wherein the polarity of the primary bias potential is different from the polarity of the secondary bias potential, and the polarity of the irradiating charged particle current for forming the secondary electrostatic latent image is different from the polarity of the irradiating charged particle current for correcting the secondary electrostatic latent image.

* * * * *